United States Patent [19]

Hooker et al.

[11] 4,433,844

[45] * Feb. 28, 1984

[54] DRIVE MECHANISM FOR A VARIABLE SPEED GAMING DEVICE

[75] Inventors: Donald E. Hooker, Wilmette; Roman A. Tojza, Chicago, both of Ill.

[73] Assignee: Bally Manufacturing Corporation, Chicago, Ill.

[ * ] Notice: The portion of the term of this patent subsequent to Feb. 15, 2000 has been disclaimed.

[21] Appl. No.: 385,009

[22] Filed: Jun. 4, 1982

Related U.S. Application Data

[62] Division of Ser. No. 136,818, Apr. 3, 1980, Pat. No. 4,373,727.

[51] Int. Cl.[3] ..... A63F 5/04

[52] U.S. Cl. ..... 273/143 R; 273/138 A

[58] Field of Search .....
273/143 R; 143 C; 138 A; 1 E; 1 GC

[56] References Cited

U.S. PATENT DOCUMENTS 4,037,845 7/1977 Hooker ..... 273/138 A
4,373,727 2/1983 Hooker et al. ..... 273/143 R

*Primary Examiner*—Vance Y. Hum
*Assistant Examiner*—MaryAnn Stoll
*Attorney, Agent, or Firm*—Welsh & Katz

[57] ABSTRACT

A drive mechanism for a game device of the type that has a number of rotatable reels having symbols or other indicia on the outer surface thereof, which reels are rotated and subsequently preferably sequentially stopped during each play. The game device has an operating handle that is pulled through its operating stroke by a player and the reels are rotating at a speed that is directly proportional to the speed with which the handle is pulled. Electrical circuitry detects the speed of movement of the handle and varies the strength of an electrical signal that is applied to a drive mechanism which accordingly drivingly rotates the reels at a speed that is proportional to the strength of the signal.

8 Claims, 13 Drawing Figures

DRIVE MECHANISM FOR A VARIABLE SPEED GAMING DEVICE

This is a division of application Ser. No. 136,818, filed Apr. 3, 1980 now U.S. Pat. No. 4,373,727.

The present invention generally relates to amusement or game devices and more particularly to game devices of the type which have one or more indicia-bearing rotatable reels that are rotated in response to a player pulling an operating handle, which reels are subsequently stopped at the completion of a play.

As is comprehensively set forth in our co-pending application entitled "Gaming Apparatus Having Manually Controllable Operating Speed", Ser. No. 119,217, filed Feb. 7, 1980, now abandoned in favor of divisional application Ser. No. 305,480, Sept. 25, 1981, amusement or game devices of the type which have at least one indicia-bearing rotatable reel and preferably three or more of such reels have been in existence for decades and have more recently been the subject of considerable research and development, in large part because of the increased popularity of the devices, together with new and improved features that are more easily incorporated into the design and construction of the devices because of advances in technology, and particularly electronic technology. Game devices of this type were originally mechanical devices but have now evolved into electromechanical devices. A common characteristic of the prior art mechanical and electromechanical devices has been that the player pulling the handle which initiates the spinning of the reels, resulted in the reels spinning at a generally constant initial speed, whether the rotation initiating force was produced through a strictly mechanical drive mechanism or from an electrical drive motor or solenoid based drive mechanism. This meant that the initial speed of rotation or angular velocity that was imparted to the reels was generally constant regardless of the speed with which the operating handle was pulled. As is discussed in the above-referenced patent, the game device which incorporated a mechanical drive mechanism that permitted the initial rotation to be varied in accordance with the speed with which the operating handle was pulled by a player represents a new feature that appeals to many players of such devices, for it contributes to the feeling that the player is at least partially controlling the operation of the game device. The initial rotation of the reels, while being directly proportional to the speed with which the operating handle is pulled, occurs through the operation of a mechanical linkage that effectively transmits the force applied to the handle to a shaft and to the reels that were carried by the shaft. Unlike the mechanism disclosed in our above-referenced patent, the present invention does not utilize a direct mechanical linkage for initiating rotation of the reels, but uses electronic circuitry for effectively detecting the speed of movement of the operating handle through its operating stroke and thereafter applies an electrical signal to an electrical motor means associated with a drive mechanism, and the strength of the electrical signal is proportional to the detected speed and thereby varies the speed of initial rotation that is imparted to the reels. The circuitry is also adapted to vary or alter the issuance of electrical signals that effectively cause the reels to be stopped, with the duration of the period of rotation or spin time for each reel varying in accordance with the detected speed of the pulling of the handle. The rhythm, or cadence, of a slot machine as the reels stop sequentially is a recognized characteristic of the machine.

It is therefore an object of the present invention to provide an amusement or game device which has the aforementioned advantages of enabling the player to vary the initial speed of rotation of the reels during a play, wherein the device is of relatively simple mechanical design and is economical to manufacture.

It is also an object of the present invention to provide an amusement or game device of the foregoing type having rotatable reels wherein the duration of the spinning of each of the reels is varied in proportion to the speed in which the handle is pulled through its operating stroke.

Yet another object of the present invention is to provide an improved game device having a drive mechanism of relatively simple design, together with electrical circuitry which varies the strength of the electrical signals that operate the drive mechanism to easily accomplish variation of the speed of rotation in accordance with the speed of movement of the operating handle.

Yet another object of the present invention is to provide a game device as described in the foregoing object which is extremely reliable in its operation and which has an extended useful life.

Other objects and advantages of the present invention will become apparent upon reading the following detailed description, while referring to the attached drawings, in which.

Broadly stated, the present invention is directed to an amusement device which is operated by a player pulling the operating handle through its full operating stroke, which results in the reels being spun at a speed that is proportional to the speed with which the player has pulled the handle, and also results in the time during which the reels rotate varying in proportion to the handle speed. The control of the initial speed of rotation of the reels is accomplished by electrical circuitry detecting the speed of movement of the handle through its forward operating stroke, generating electrical signals which vary in accordance with the detected speed and applying the signals to a relatively simple drive mechanism which imparts the rotating force to a ratchet wheel that is attached to a shaft that carries the reels. The variation in the "spin time" or duration of rotation of the reels is accomplished by utilizing the generated electrical signals that are a function of the detected handle speed to control the actuation of the reel stopping indexing mechanism, preferably in a manner whereby the faster the handle is pulled, the shorter the spin time of the reels.

The drive mechanism has an electrically operated solenoid (although a d.c. motor or the like could be used) with a retractable plunger that is connected to structure which engages the ratchet wheel. A number of half cycles of rectified a.c. voltage drives the solenoid and the electrical circuitry is adapted to apply selectively abbreviated half cycles to the solenoid to control the power that is applied to it which effectively controls the speed with which the plunger operates. The slower the operating handle is moved, the later the triggering of circuit components which initiate the application of each half cycle of the rectified voltage which is applied to the solenoid coil. Thus, there is less power applied to the solenoid coil because the triggering occurs at a late position in each half cycle and results in slower operation of the plunger as is desired.

Figure 1:
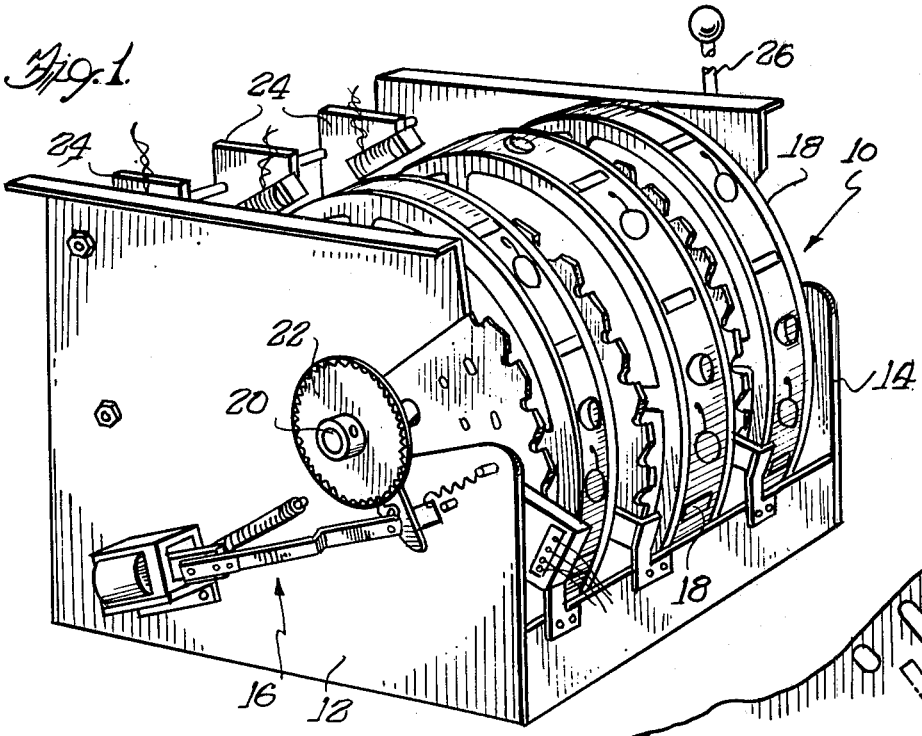
FIG. 1 is a perspective view of the front and left sides of a substructure of an amusement or game device which embodies the present invention and which particularly illustrates the drive mechanism of the present invention.
Figure 2:
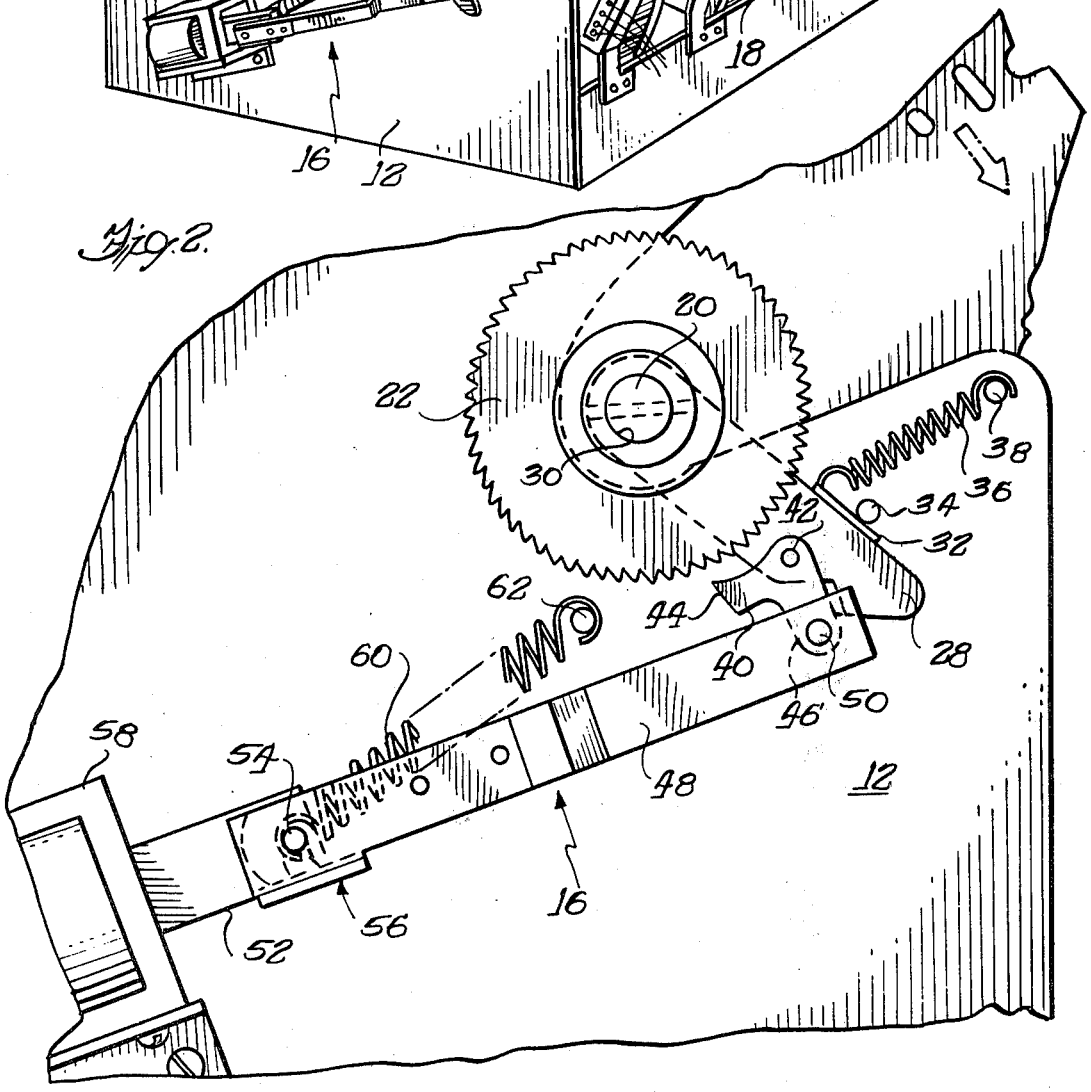
FIG. 2 is a fragmentary side elevation of the left side of the substructure shown in FIG. 1, particularly illustrating the drive mechanism of the present invention, with the same being shown in its disengaged or rest position.
Figure 3:
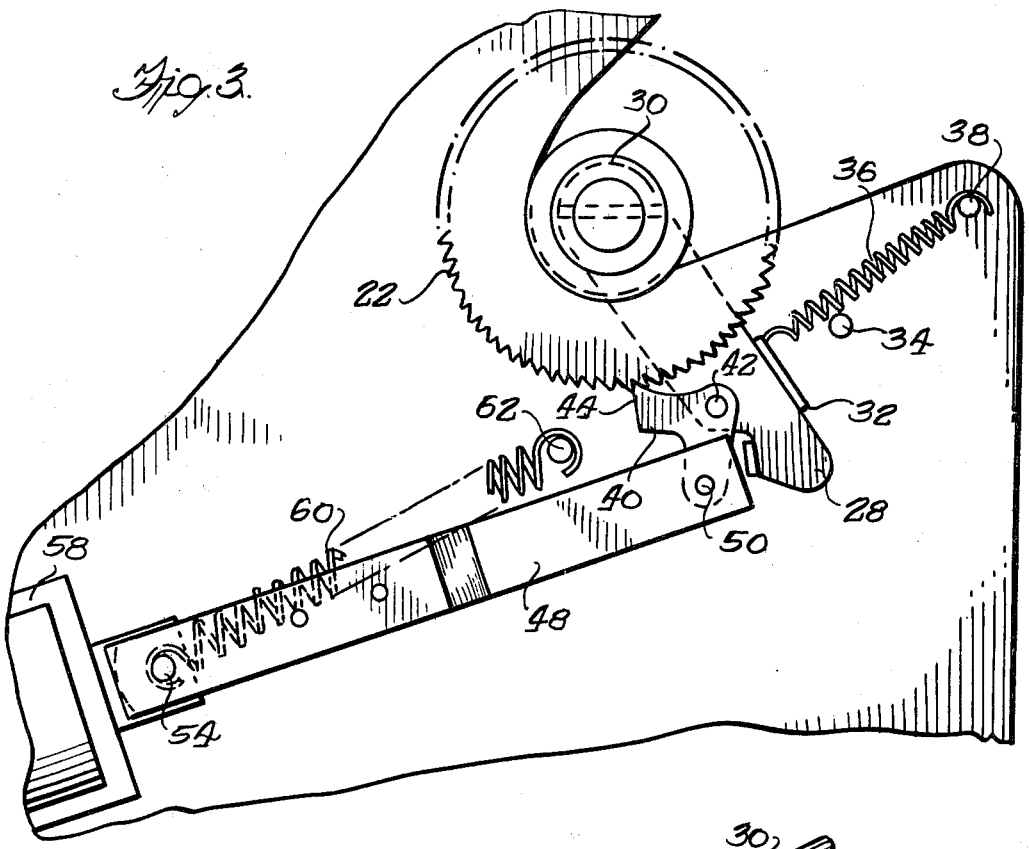
FIG. 3 is a fragmentary side elevation similar to FIG. 2, and particularly illustrating the drive mechanism in its engaged position, immediately after application of rotating force to a ratchet wheel that is attached to a shaft carrying the rotatable reels.
Figure 4:
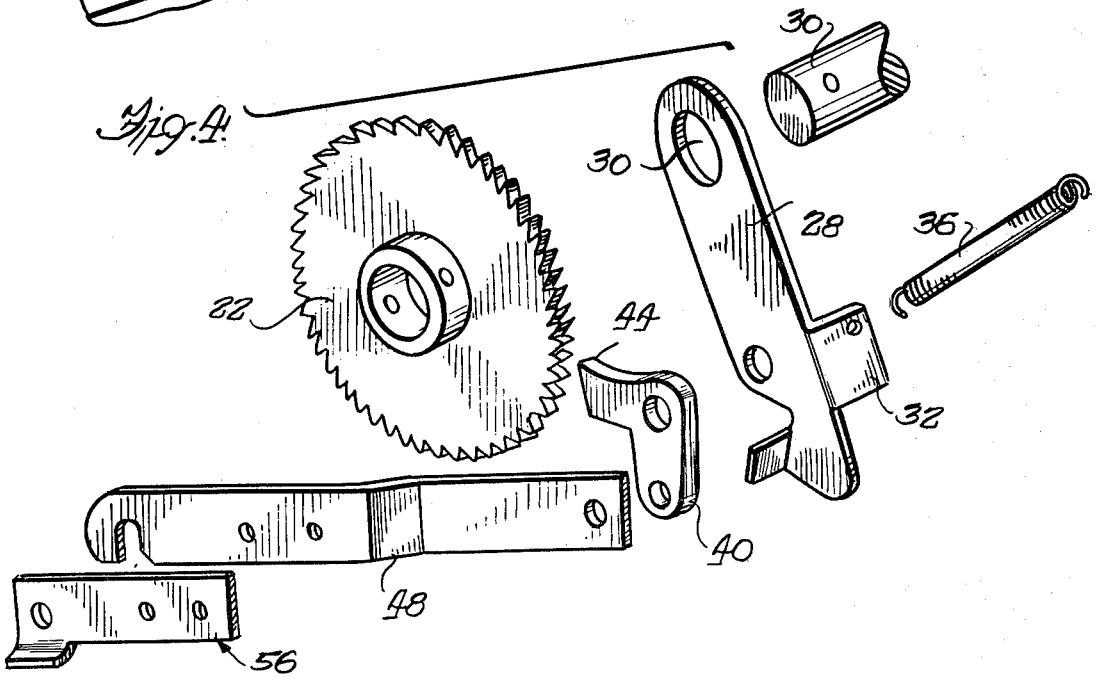
FIG. 4 is an exploded perspective view of the major components of the drive mechanism shown in FIGS. 1–3.

Turning now to the drawings and particularly FIGS. 1–3, the drive mechanism will initially be described. A game device structure, indicated generally at 10, is shown in FIG. 1 to include side walls 12 and 14, the left wall 12 of which provides a support surface to which a drive mechanism 16 embodying the present invention is attached. A number of indicia-bearing rotatable reels 18 are shown and are carried by a shaft 20 to which a ratchet wheel 22 is attached. The reels are provided with one way rotational clutch bearings (not shown) which enable each of the reels to be driven in the drive rotational direction by the drive mechanism, but which are free to rotate relative to the shaft in the opposite direction. The ratchet wheel 22 is engaged by the drive mechanism 16 for imparting the initial force for spinning the reels during play. The reels are preferably sequentially stopped by individual indexing mechanisms 24, preferably of the construction shown in our aforementioned application and an operating handle 26 is shown to the right of the substructure and is pulled by a player to initiate operation of the game device.

It should be understood that play of the device may require insertion of one or more coins in the device, but as soon as the device is enabled by doing so, the handle may be pulled by the player. The structure relating to the insertion and verification of the insertion of such coins is not a part of the present invention but can be incorporated into the game device described herein in a conventional manner.

In accordance with an important aspect of the present invention and referring to the drive mechanism 16 shown in FIGS. 1 and 2, it is relatively simple in its design and operation, which contributes to its reliability and economical manufacture and maintenance. The drive mechanism includes an elongated plate means 28 that has an aperture 30 in the upper end thereof which fits around the shaft 20 and is rotatable relative to it. The plate 28 is shown in its rest position, and has a tranverse flange 32 that bears against a pin 34 attached to the side wall 12. A tension spring 36 having one end attached to the flange 32 and an opposite end attached to another pin 38 biases the plate 28 to the position as shown. The plate 28 also carries a pawl 40 pivotally attached thereto by a pin 42, with the pawl having an outer edge 44 for engaging the teeth of the toothed ratchet wheel 22 during operation. The pawl 40 also has an extension 46 to which a link 48 is attached via pin 50 with the link 48 having its opposite end attached to a retractable plunger 52 by a pin 54. As is conventional, the link 48 has a releasable snap connector 56 that permits easy release of the link from the plunger 52 for maintenance purposes. The plunger 52 is part of an electrically operated solenoid 58 which, when energized, causes the plunger to retract or more to the left as shown in FIGS. 1 and 2 to impart rotating force to the shaft carrying the reels. Another tension spring 60 is provided, and has one end attached to the pin 54 and the opposite end attached to another pin 62 that is secured to the side wall 12 and the spring 60 biases the plunger and link 48 toward the rest position shown in FIG. 2, i.e., to the right as shown in these drawings. It should be appreciated that the normal biasing provided by the spring 60 causes the link 48 to be biased to the right and this biasing force, by virtue of the manner in which the link is attached to the pawl 40, also biases the pawl so that its outer edge 44 is biased out of contact with the ratchet wheel 22.

As will be described in greater detail hereinafter, it is preferred that operation of the drive mechanism 16 be accomplished in essentially two steps, the first of which involves a first interval of movement which merely engages the edge 44 of the pawl 40 with the teeth of the ratchet wheel 22, the second of which involves moving the plunger 52 and link 48 through an additional interval of movement during which the ratchet is rotated by the pawl 40 to impart rotation to the ratchet wheel, shaft and reels. It should be appreciated that a single strong pulse to the solenoid 58 would retract the plunger 52 and result in the pawl engaging the ratchet wheel with substantial force, and it has been found that when this is done, considerable wear is experienced by the teeth of the ratchet wheel, which significantly shortens its effective useful life. For this reason, it is preferred that the solenoid 54 be initially energized with minimum power to cause the plunger to move slowly without great force until the pawl is engaged so as to minimize the abrupt impact that significantly increases wear.

After the pawl has engaged the ratchet wheel, maximum power is applied to the solenoid which causes further movement of the plunger 52 and link 48, resulting in the plate 28 and pawl 40 moving in a clockwise direction around the shaft 20 as shown in FIG. 3. During this movement, the flange 32 naturally moves away from the stop pin 34 as is shown in FIG. 3, the movement also extending the tension spring 36. After the energization of the solenoid 58 is terminated, the plunger will be biased back toward its rest position by the spring 60 and the plate 28 will return to its rest position and the pawl 40 will disengage the ratchet wheel 22.

Figure 5:
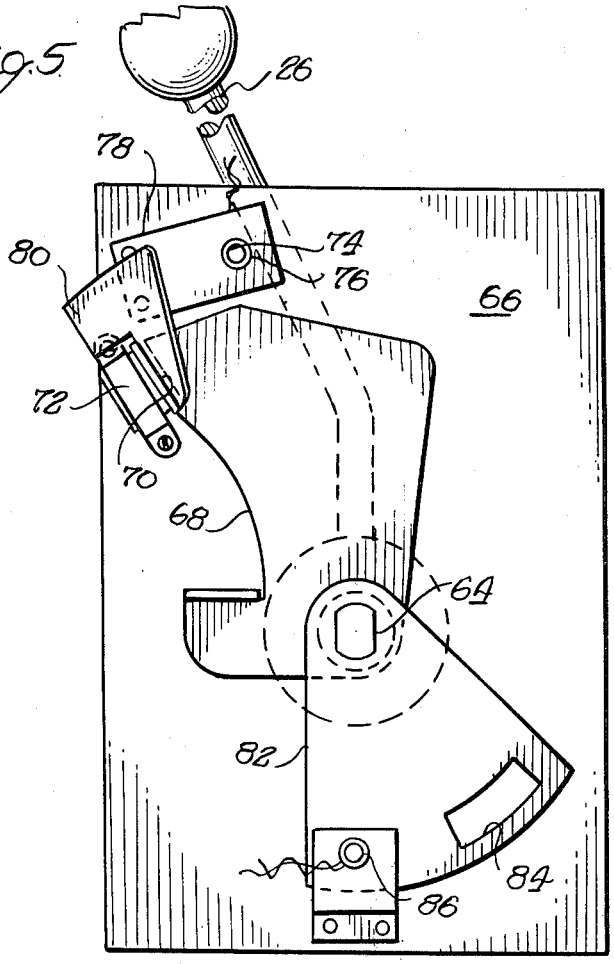
FIG. 5 is a side elevation of a portion of the operating handle of a game device, particularly illustrating the interrelationship of mechanical components, together with portions of the circuitry of the present invention which detect initial movement and speed of movement of the operating handle as it is pulled through its operating stroke.
Figure 6:
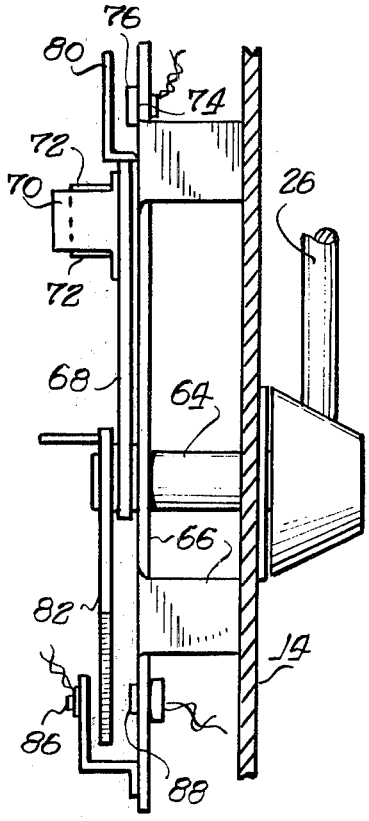
FIG. 6 is a front view, partially in section of mechanism of the structure shown in FIG. 5.

Prior to describing the circuitry in detail, reference is made to FIGS. 5 and 6 which illustrate the operating handle 26 and the interrelationship of the handle with the circuitry that detects the initial handle movement and speed of movement of the handle pull during operation. It is seen that the handle 26 is attached to a shaft 64 that is suitably journaled in apertures of the side wall 14 and in a frame structure 66. The nature of the operation of the handle 26 is that it is pulled in the clockwise direction as shown in FIG. 5 until it reaches the end of its operating stroke whereupon a frame member 68 is released and snaps back to the rest position shown in FIG. 5 where a transverse flange 70 rests against a bumper pad 72. It is preferred that some resistance to the pulling action be provided in the handle mechanism although such is not shown herein.

It is important to appreciate that the speed of movement of the plate 68 in response to pulling of the handle 26 is much slower than the speed of movement of the plate 68 when it snaps back to its rest position after the handle has been pulled to the end of its stroke. A light emitting diode 74 and phototransistor 76 are shown to be mounted on a mounting bracket 78 that is positioned to detect the movement of the plate 68 during operation. This is accomplished by a plate 80 being attached to the plate 68, with the surface exposed to the light emitting diode (LED) 74 being sufficiently reflective that the phototransistor 76 will detect the existence of the reflected light when the plate 80 is opposite the LED 74. A relatively slow positive-going transition will be produced in response to pulling of the handle 26 through its forward stroke but a sharp negative-going transition will result from the fast movement of the plate 68 snapping back to its rest position. The plate 80 is positioned so that once it places the phototransistor 76 into conduction, it will be maintained in conduction through the remainder of the forward stroke and will be switched off during the snap back movement. The handle is preferably provided with a ratchet mechanism (not shown) which does not permit the handle to be pulled any direction but forwardly until its forward stroke is completed, at which time it releases and snaps back to its rest position.

However, during the pulling of the handle 26 through its forward stroke, the speed of the movement of the handle 26 is effectively detected before the operative pulse is produced during the snap back of the plate 68 by the phototransistor 76. To this end, a plate 82 is provided with a window 84 therein which passes a phototransistor 86 that is located on one side of the plate, there being a light emitting diode or other light source 88 on the opposite side. Thus, the phototransistor will be placed into conduction during the time the window 84 passes light from the LED 88 which is a function of the speed of movement of the handle 26 through its forward stroke. The circuitry of the present invention ignores the conduction of phototransistor 86 during the return movement of the handle 26.

Figure 7:
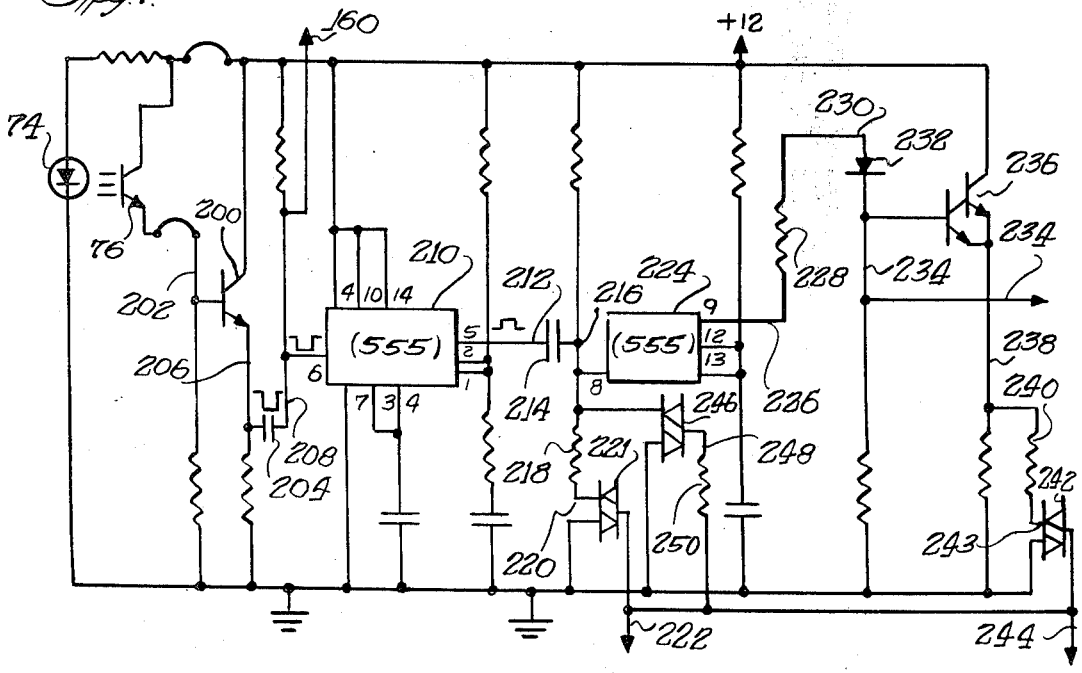
FIGS. 7, 8 and 9 illustrate electrical circuit schematic diagrams of the circuitry of the present invention which controls the operation of the game device.
Figure 8:
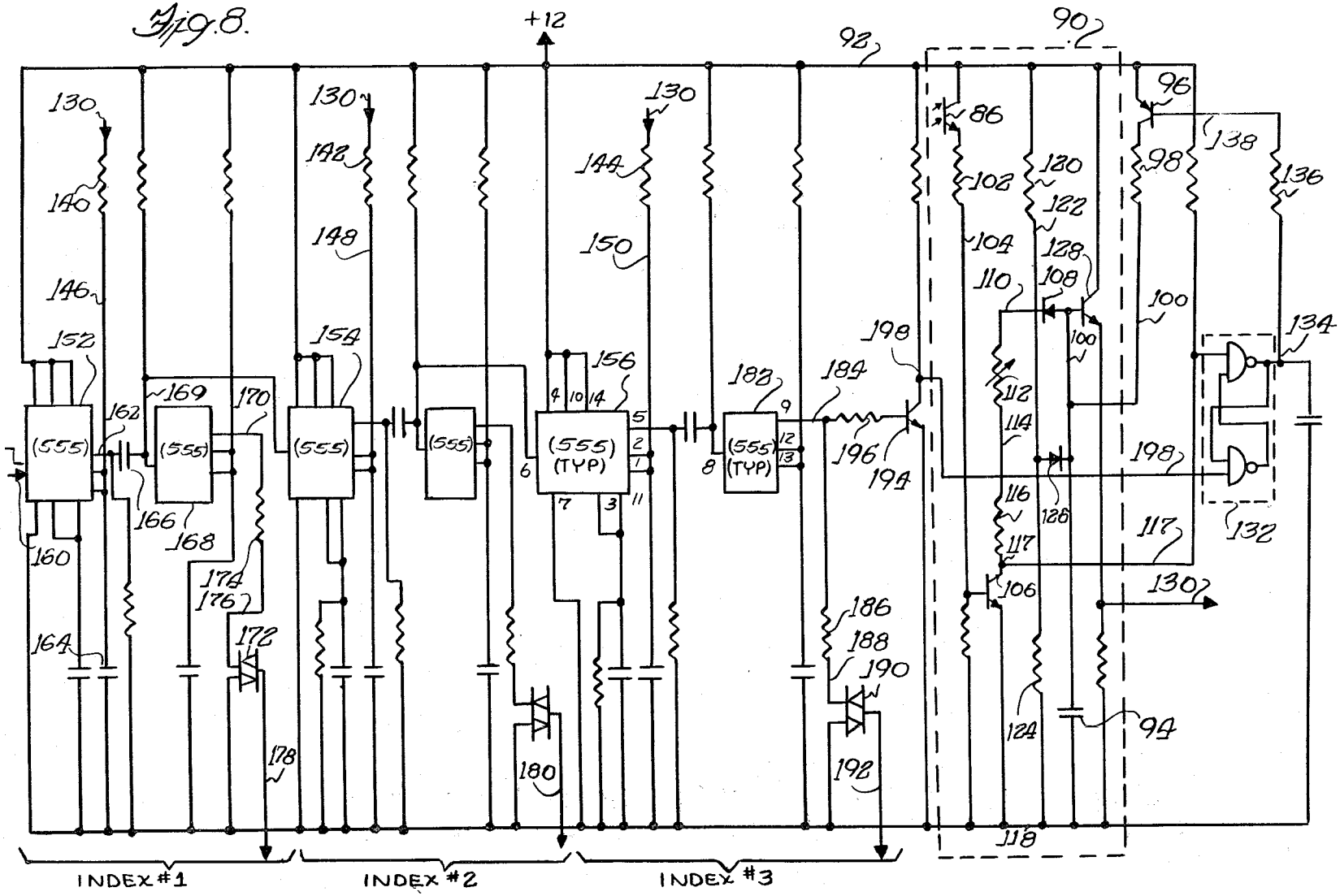
Figure 9:
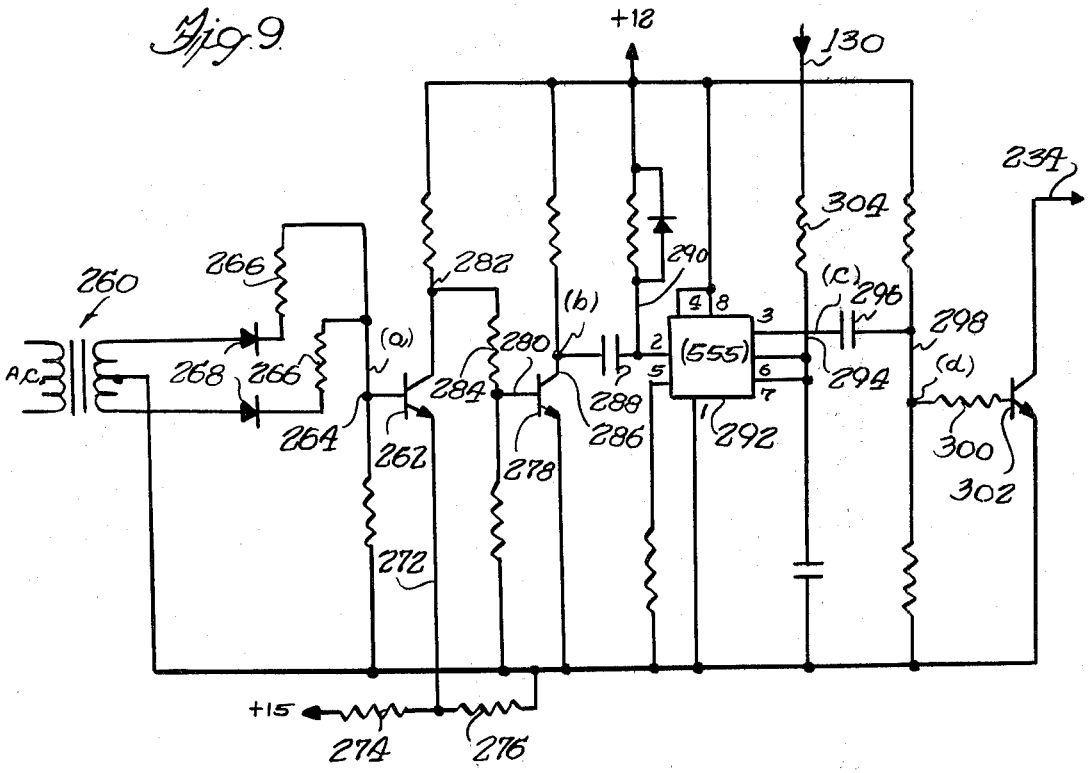

Turning now to the circuitry shown in the electrical schematic diagrams of FIGS. 7–9, and particularly FIG. 8, circuitry shown within the dotted lines 90 provides an electrical voltage that has a variable magnitude that is a function of the speed with which the handle 26 is pulled through its forward stroke. This is accomplished by the phototransistor 86 which has its collector connected to line 92 that has a positive voltage of 12 volts, for example. When the window 84 passes the phototransistor 86, it is placed into conduction and operates to effectively discharge a capacitor during this time. Thus, if the handle is being pulled slowly, the window will be present between the LED 88 and phototransistor 86 for a longer time and phototransistor 86 will be conducting for a longer time and thereby discharge the capacitor to a lower voltage that would otherwise occur if the handle was being rapidly pulled.

The capacitor that is being discharged is capacitor 94 and its charging and discharging occurs in the following manner. Before the phototransistor 86 is placed into conduction, a normally conducting transistor 96 applies positive voltage from line 92 through the transistor 96, a resistor 98 and line 100 and thereby provides a maximum charge of preferably about 11 volts on the capacitor 94. When phototransistor 86 is conducting, voltage is applied via resistor 102 and line 104 to the base of transistor 106 which switches it into conduction. When transistor 106 is conducting, the charge on capacitor 94 will be drained through a path defined by line 100, diode 108, line 110, variable resistor 112, line 114, resistor 116, the collector-emitter path of transistor 106 to ground line 118 and the discharging will occur until the window passes.

It is preferred that the discharge not be below a minimum optimum level for the remaining circuitry, which is about 7 volts and this is accomplished by providing a minimum voltage on line 100 by operation of resistor 120, line 122, resistor 124 and diode 126, so that the minimum voltage is always present on line 100. Thus, the capacitor 94 cannot be discharged below the minimum level that is provided by the divider action of the resistors 120 and 124. Line 100 is also connected to the base of a transistor 128 which is preferably a very high gain transistor, i.e., within the range of about 100 to 1000, so that little current is drained from the capacitor which would affect its charge. The emitter of transistor 128 is connected to line 130 which provides an output voltage which varies in direct proportion to the speed by which the handle is pulled, preferably within the range of about 7 to 11.7 volts, with the higher voltage indicating a faster pull, since less charge will be drained from the capacitor 94. A flip-flop 132 has an input line 117 which goes low as soon as transistor 106 is placed into conduction and by so doing causes the output line 134 of flip-flop 132 to go high which, through resistor 136 and line 138, places transistor 96 in a nonconducting state so that it will not be charging the capacitor during the time it is being purposely discharged. As will be described, after the particular play of the device has been completed, the flip-flop 132 will be set which will place the transistor 96 back into conduction to recharge the capacitor to its full charged state as is desired.

The voltage on line 130 that varies in proportion to the speed with which the handle is pulled, is applied to four different locations elsewhere in the circuitry, three of which are shown in FIG. 8 and which control the duration of the output signal of respective timer circuits that are associated with indexing or stopping mechanisms for each of the three reels. This has the effect of varying the spin time of the reels in accordance with the speed of the handle being pulled. As will become evident from the description of the circuitry that will be described, the faster the handle is pulled, the shorter the spin time of the reels. Also the circuitry is designed to sequentially stop the reels, with the spin time of each reel being effectively varied in an inversely proportional manner. It should be appreciated that all of the reels could be simultaneously stopped if desired, but players generally like the sequentially stopping of the reels. More particularly with respect to the circuitry, the voltage on line 130 is applied via resistors 140, 142 and 144, respective lines 146, 148 and 150 to respective timers 152, 154 and 156 as shown. The pin numbers for the connections of the integrated circuits of the timers which are conventional type 555 timers are shown for the timer 156 which is typical of the other timers 152 and 154.

As is evident from FIG. 8, there is a duplication of circuitry for each of the index mechanisms that are used to stop the rotation of each of the three reels and only one of the circuits will be described, the others operating in a similar manner. Thus, referring to the circuitry associated with indexing mechanism number 1, a start pulse, i.e., a negative-going transition is applied to line 160 which begins operation of the timer 152. Its output line 162 will immediately go high upon triggering and the output level will remain high until the voltage on capacitor 164 reaches the threshold voltage in the timer. The time in which the threshold voltage is reached is a function of the voltage on line 130 and the higher the voltage on line 130, the faster the charging of capacitor 164 to the threshold voltage of the timer. Thus, when the handle is pulled rapidly, the voltage on line 130 is proportionally higher and the timer then triggers the indexing mechanism more quickly. The triggering is accomplished in the following manner. When the output line 162 goes low after the timer has timed out, the negative-going pulse is passed through capacitor 166 and line 169 to trigger another timer 168 and its output line 170 immediately goes high which is applied to the trigger input of a triac 172 via resistor 174 and line 176. The triac 172 is thus placed into conduction and provides a signal on line 178 which causes the indexing mechanism to operate and stop reel number 1.

At the time the negative-going transition of the output line 162 triggers the timer 168 via line 169, it also triggers the timer 154 which will operate in similar fashion and eventually provide a signal on line 180 that will cause the indexing mechanism associated with the second reel to operate and stop its rotation. In a similar manner, timer 156 will operate together with a timer 182 which has output line 184 that extends via resistor 186 and line 188 to trigger a triac 190 that has output line 192 that extends to the third indexing mechanism for stopping the third reel. The output line 184 is also connected to the base of a transistor 194 via resistor 196 to place it into conduction and when this is done, the line 198 connected to its collector will be switched from a high to a low level. Line 198 extends to the set input of the flip-flop 132 which sets it resulting in line 134 going low which places transistor 96 into conduction to thereby recharge the capacitor 94. It should be apparent that the recharging of the capacitor occurs at the conclusion of play, since all three reels have been stopped before the flip-flop 132 is set.

To obtain the initial negative-going transition on line 160 that triggers the first timer 162, reference is made to FIG. 7 which contains circuitry that generates this signal as well as other signals that will be hereinafter described. The phototransistor 76 is shown in the upper left portion of the circuitry and is adapted to be placed in conduction when the plate 80 passes in close proximity so as to reflect the light from the LED 74 so that it is detected by the phototransistor 76. During forward movement of the handle 26, it is placed into conduction and the emitter of phototransistor 76 is connected to the base of another transistor 200 via line 202. When transistor 76 is conducting, transistor 200 is conducting and its emitter is connected to a capacitor 204 via line 206. The transistor is maintained in conduction during the entire forward movement of the handle 26 and does not provide the negative-going transition on line 208 for triggering a timer 210 until it is switched off incident to the plate snapping back after the handle has been pulled through its complete stroke. When the plate 68 snaps back, a very fast pulse will be produced which is effective to trigger the timer 210 and it will provide a positive output on line 212 for a period of preferably about 200 milliseconds. Line 212 is connected to capacitor 214, line 216, resistor 218 and line 220 to the trigger input of the triac 221 which has output line 222 that is connected to a reset mechanism for resetting all of the indexing mechanisms and effectively frees the reels for subsequent rotation. Thus, as soon as the timer 210 is triggered, its output line 212 will go high which will trigger the triac 221 and reset the indexing mechanisms. After the timer times out, the negative transition will be passed through capacitor 214 to line 216 which triggers another timer 224 having output line 226 which is connected through resistor 228, line 230, diode 232, and line 234 to the base of a Darlington pair transistor 236. Transistor 236 has its emitter connected through line 238, resistor 240 and line 243 to the trigger of a traic 242 that has output line 244 connected to the solenoid 58 of the drive mechanism 16 for driving the same.

In accordance with an important aspect of the present invention and as previously mentioned, it is desired that the pawl 40 initially engage the ratchet wheel 22 before the main drive signals are applied to the drive mechanism to minimize any wear that would otherwise occur by rapidly impacting the pawl with the ratchet wheel. Thus, it is desired to have the pawl slowly engage the ratchet and this is accomplished by the circuitry of FIG. 7 in the following manner. When the timer 210 is initially triggered, the signal on line 212 goes high and it is passed through capacitor 214 to line 216 which is also connected to the trigger input of a triac 246 which has its output line 248 connected to a resistor 250 which effectively reduces the voltage so that a low level voltage is present on line 244 from the triac 246 for operating the solenoid 58 so that the plunger 52 is slowly retracted to relatively slowly engage the pawl 40 with the ratchet.

Figure 10:
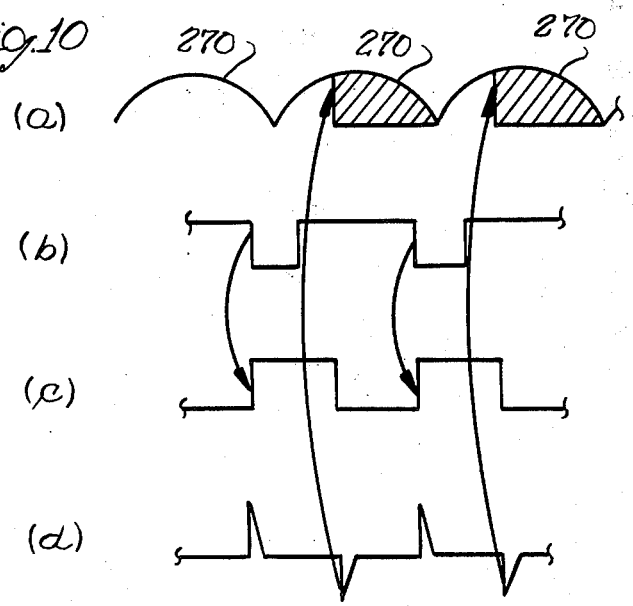
FIGS. 10(*a–d*) illustrates a number of timing diagrams that are helpful in understanding the nature of the operation of portions of the circuitry shown in FIGS. 7 and 9.

To control the drive mechanism 16 so that it will drive the ratchet wheel at a speed that is directly proportional to the speed with which the handle 26 is pulled, the circuitry of FIG. 9 is provided and includes a transformer 260 that has its primary winding connected to a source of alternating current voltage and its secondary connected to the base of a transistor 262 via line 264 through resistors 266 and diodes 268. Thus, the voltage on line 264 is a continuous half wave rectified a.c. signal as is shown by the line 270 of FIG. 10*a*. The emitter of transistor 262 is connected to line 272 to resistors 274 and 276 which maintain a voltage that is slightly elevated and has the effect of placing the transistor in conduction only when the magnitude of the half wave rectified voltage is above a certain level. When transistor 262 conducts, it places transistor 278 into a state of nonconduction, since its base 280 is connected to the collector 282 of transistor 262 through resistor 284. The collector voltage of transistor 278 is shown in FIG. 10*b*. Whenever the collector of transistor 278 has a negative-going transition, it is passed through a capacitor 288 to line 290 which triggers another timer 292 which has output line 294 that immediately goes high. The duration of the high signal on line 294 is determined by the voltage on line 130 so that the time interval varies inversely as the voltage on line 130 in the same manner as previously described with respect to the timers 152, 154 and 156. The waveform of the output on line 294 is shown in FIG. 10*c*. A capacitor 296 is connected to line 294 as well as to line 298 that extends through resistor 300 to the base of a transistor 302 which has line 234 connected to the collector thereof. The signal on line 294 will be differentiated by the capacitor 296 so that positive-going transitions will appear as positive spikes and negative-going transitions will appear as negative spikes as shown in FIG. 10*d*. Whenever a negative spike is applied to the base of transistor 302, it will be momentarily switched off which will cause line 234 going high. Whenever line 234 goes high, and referring to FIG. 7, the output signal from the timer 224 appearing on line 226 will be effectively applied to the base of the Darlington transistor 236 and permit it to trigger the triac 242. As long as the line 234 is low which occurs when transistor 302 is conducting, the triac cannot be triggered. Thus, the varying voltage on line 130 effectively delays the triggering of the triac 242 for each half cycle so that the power applied to the solenoid 58 is also varied. As shown in FIG. 10*a*, the area shown by the cross-hatched lines represents the power of each half cycle that is applied to the solenoid 58. When the handle is pulled more slowly, the triggering will occur later in the half cycle which will result in less force being applied by the drive mechanism 16 as is desired.

From the foregoing detailed description it should be appreciated that an improved game apparatus has been shown and described. The desirable features which enable a player to control the initial rotational speed of the reels as well as the duration of the spinning of the reels is present in the apparatus, and is carried out using a relatively economical drive mechanism together with a unique electrical circuit design. While both features, i.e., control of the initial speed of the reels and control of the spin time of the reels, are shown and described, it should be appreciated that a game device could have only one of the features if desired. Thus, the spin time could be made generally constant by connecting resistors 146, 148 and 150 to line 92 rather than line 130, for example (see FIG. 8), and the initial speed could be made constant while varying only the spin time by connecting the resistors 146, 148 and 150 to line 130 as shown and connecting a resistor 304 (FIG. 9) to a constant voltage of 12 volts, for example, rather than to line 130 as shown. While the circuitry disclosed herein is fabricated from conventional circuit components and integrated circuits, it should be readily apparent to those skilled in the art that a microprocessor or microcomputer could be used to accomplish what is done by the circuitry that is disclosed.

It should be understood that while certain preferred embodiments of the present invention have been illustrated and described, various modifications, alternatives and substitutions will become apparent to those skilled in the art, and, accordingly, the scope of the present invention should be defined only by the appended claims and equivalents thereof.

Various features of the present invention are set forth in the following claims.

What is claimed is:

1. A drive mechanism for actuating and rotating a rotatable shaft to which a toothed ratchet means is attached in response to movement of an operating handle through an operating stroke, comprising:

plate means that is movable from a rest position to an extended position;

pawl means pivotably carried by said plate means and being adapted to move from a rest position to engage the ratchet means for rotating the same during operation;

drive means operably connected to said pawl means and plate means and adapted to move said pawl means from a rest position and cause said pawl means to engage said ratchet means during a first interval of movement and to drivingly rotate said ratchet means and shaft during a further interval of movement, said drive means operating at a speed that is proportional to the strength of the electrical signal applied thereto;

circuit means for generating the electrical signals and applying the same to said drive means, the strength of the signals being proportional to the speed with which said operating handle is moved through its operating stroke.

2. A drive mechanism as defined in claim 1 wherein said plate means is rotatable around said shaft.

3. A drive mechanism as defined in claim 1 including means for biasing said drive means and plate means toward their respective rest positions.

4. A drive mechanism as defined in claim 1 wherein said drive means comprises an electrically powered motor means having an output means that is movable from said rest position to an actuated position, said output means being connected to said pawl means.

5. A drive mechanism as defined in claim 4 wherein said motor means comprises a solenoid and said output means is an elongated plunger means, energization of said solenoid causing said plunger means to be retracted therewithin and initially move said pawl means into engagement with said ratchet means and to thereafter rotate said ratchet means and shaft.

6. A drive mechanism as defined in claim 5 wherein said pawl means is pivotably connected to said plate means and said plunger means is connected to said pawl means at a location whereby retraction of said plunger means pivots said pawl means into engagement with said ratchet means.

7. A drive mechanism as defined in claim 1 wherein said circuit means comprises:

means responsive to the start of movement of said operating handle for generating a first electrical signal for moving said drive means through said first interval of movement to engage said pawl means with said ratchet means;

means responsive to the speed with which said handle is moved through its operating stroke for generating electrical signals for application to said drive means for moving said pawl means and plate means to rotate said ratchet means and shaft, the strength of said electrical signals varying in direct proportion to the speed of handle movement through its operating stroke.

8. A drive mechanism as defined in claim 7 wherein said circuit means includes means for generating and applying a plurality of half cycles of rectified a.c. voltage to said drive means, said speed responsive means including means for varying the time of starting the application of each half cycle of said rectified a.c. voltage to thereby adjust the power applied to said drive means, said time of starting of each half cycle occurring later within each half cycle in response to the handle being moved more slowly through its operating stroke.

* * * * *